United States Patent [19]

Arimoto

[11] Patent Number: 4,560,848

[45] Date of Patent: Dec. 24, 1985

[54] CIRCUIT BREAKER OF SPIRAL ARC TYPE

[75] Inventor: Satomi Arimoto, Hyogo, Japan

[73] Assignee: Mitsubishi Denki Kabushiki Kaisha, Tokyo, Japan

[21] Appl. No.: 608,160

[22] Filed: May 8, 1984

[30] Foreign Application Priority Data

May 9, 1983 [JP] Japan ..... 58-81882
Jun. 9, 1983 [JP] Japan ..... 58-103062

[51] Int. Cl.[3] ..... H01H 33/18
[52] U.S. Cl. ..... 200/147 A; 200/147 R
[58] Field of Search ..... 200/147 A, 147 R

[56] References Cited

U.S. PATENT DOCUMENTS

| | | | |
|---|---|---|---|
| 2,725,446 | 11/1955 | Slepian | 200/147 A |
| 3,082,307 | 3/1963 | Greenwood et al. | 200/147 A |
| 3,082,308 | 3/1963 | Baker | 200/147 A |
| 3,892,461 | 7/1975 | Keto | 200/147 A |

OTHER PUBLICATIONS

Commutation-Type DC Interruption in the Spiral Arc System—Mizuno et al., Periodical Dissertations, vol. 101, No. 10, pp. 611-618, The Institute of Electrical Engineers of Japan.

Action of Arc and Interrupting Characteristics in a Rotary Arc-Type $SF_6$ Gas Breaker—Fujiwara, Periodical Dissertations, vol. 101, No. 4, pp. 181-188, The Institute of Electrical Engineers of Japan.

*Primary Examiner*—Robert S. Macon
*Attorney, Agent, or Firm*—Bernard, Rothwell & Brown

[57] ABSTRACT

A circuit breaker comprising a cylindrical fixed contact, a cylindrical movable contact and a magnetic field producing means which renders the arc current spiral when created in a space between the fixed and movable contacts in the open-contact state, wherein the magnetic field producing means produces the magnetic field having a component which traverses the intercontacts space in the direction perpendicular to the axis of the space.

2 Claims, 13 Drawing Figures

FIG. 10
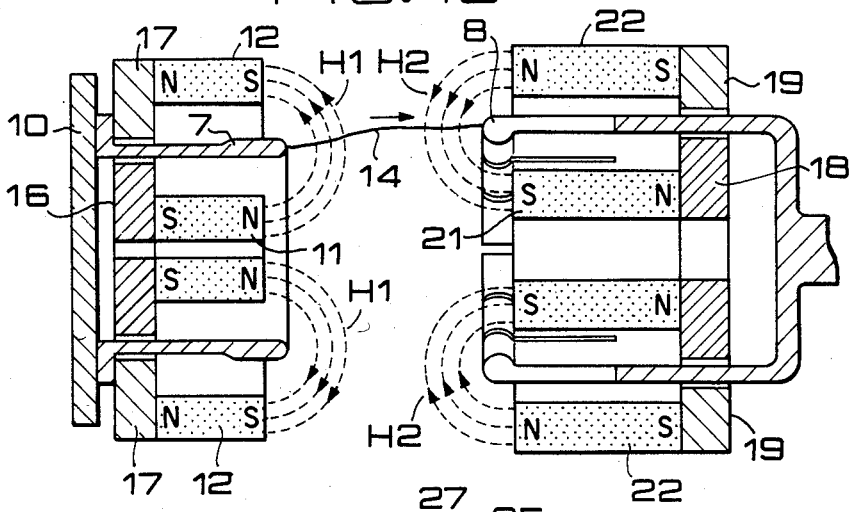
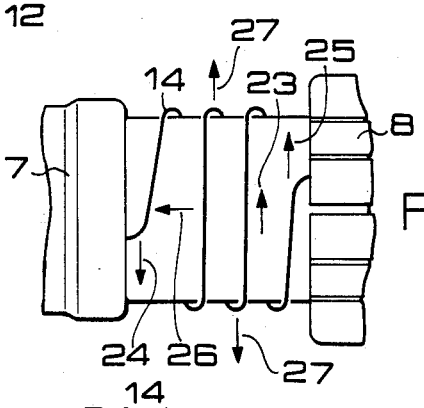
FIG. 11
FIG. 12
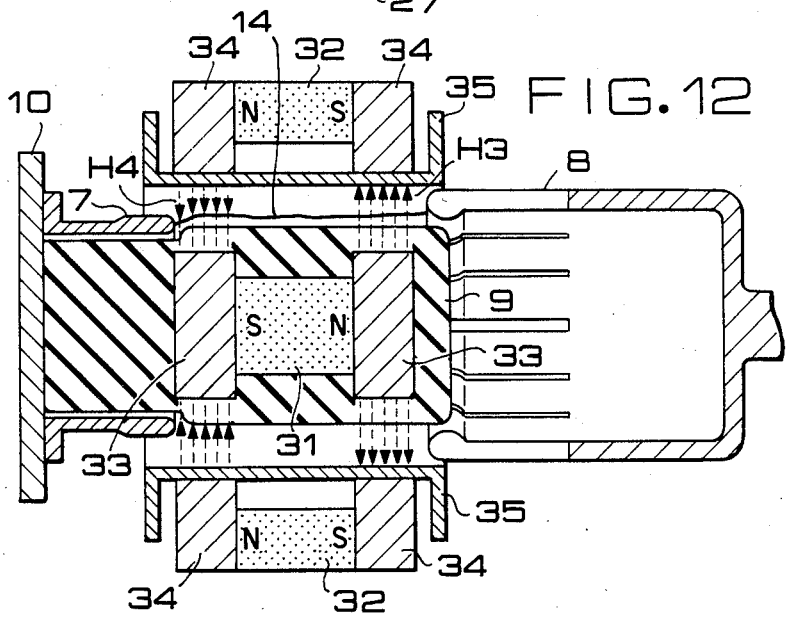

CIRCUIT BREAKER OF SPIRAL ARC TYPE

BACKGROUND OF THE INVENTION cl Field of the Art

The present invention relates to a circuit breaker of so-called spiral arc type, in which the current is shut off by forming the arc in the shape of spiral, for use, for example, in a high voltage d.c. circuit and, particularly, to a circuit breaker having an improved arc extinction chamber.

D.C. circuit breakers fall into the puffer blast type and the spiral arc type. The puffer blast type disadvantageously needs a large operating force for blasting the arc. Whereas, the spiral arc type, in which the magnetic field is applied to the tips of contacts in the arc extinction medium (e.g., $SF_6$ gas) so as to stretch the arc in the shape of spiral thereby to increase the arc voltage as high as the power voltage so that a high-voltage, large current is shut off, can produce a high arc voltage between less distant electrodes due to the sprially shaped arc, and needs a small operating force merely for driving the contact electrodes, allowing advantageously a compact and light weight design.

FIG. 1 is a sectional view showing, as an example, the principal portions of the arc extinction chamber of the conventional d.c. circuit breaker of spiral arc type. The arrangement includes a cylindrical fixed contact 1, a movable contact 2 formed in the shape of deformed cylinder with the E-shaped cross section and disposed detachably and coaxially with respect to the fixed contact 1, an excitation winding 3 disposed coaxially outside both contacts 1 and 2 and adapted to produce the magnetic field H in parallel to the central axis of the contacts 1 and 2, and an insulator 4 made of Teflon and the like attached to the surface of the movable contact 2 confronting the fixed contact 1.

The operation of the above-mentioned conventional spiral-arc d.c. circuit breaker will be explained. When arc 5 is created by the separation of the contacts 1 and 2, the current flowing in the portion referred to by 6 in the movable contact 2 is opposite in direction to the current caused by the arc 5, resulting in the generation of an electromagnetic reaction force between both currents, and the arc 5 is pushed outwardly as shown. This creates orthogonal components in the current caused by the arc 5 and in the magnetic field H, producing an electromagnetic force based on the Fleming's left-hand rule between the components, and both ends of the arc 5 move oppositely along the circumferential direction and the arc grows into a spiral. As a result, the arc voltage increases, providing the ability of shutting off a high-voltage, large d.c. current.

On this account, it is a prerequisite for the conventional spiral-arc circuit breaker to reverse the direction of the current flowing in the movable contact 2, resulting disadvantageously in a complex structure of the movable contact 2. In addition, generation of a magnetic field having a component parallel to the moving direction of the movable contact in the vicinity of the contact section causes the aerial magnetic path to become longer as the movable contact has a longer stroke, resulting disadvantageously in a large magnetomotive force needed for the excitation winding.

SUMMARY OF THE INVENTION

It is an object of the present invention to provide a circuit breaker of spiral arc type which does not need to reverse the current flowing in the movable contact and thus allows the use of a simply structured movable contact.

Another object of the present invention is to provide a circuit breaker of spiral arc type which allows a short aerial magnetic path of the magnetic field for forming a spiral arc irrespective of the maximum distance between the fixed and movable contacts.

The principle of the present invention is that a cylindrical fixed and movable contacts spaced out from each other by a certain distance in the open-contact state form a substantially cylindrical space, across which a magnetic field is formed to have a component substantially perpendicular to the axis of the space, so that the arc current flowing in a space between the fixed and movable contacts is made to have a spiral shape by the action of the magnetic field.

In one aspect of the present invention, the circuit breaker comprises a cylindrical fixed contact, a cylindrical movable contact provided detachably with respect to the fixed contact, a first magnet accommodated inside the fixed contact, and a second magnet provided around the fixed contact, so that a magnetic field having a component traversing a space between the fixed and movable contacts is formed between the first and second magnets. The magnetic flux traversing the space between the fixed and movable contacts in the direction perpendicular to the axis of the space operates on the arc current flowing in the space between the fixed and movable contacts to bend the arc spirally based on the Fleming's left-hand rule. In consequence, the path on which the arc current flows becomes significantly longer than the actual distance between both contacts, whereby high arc extinction characteristics can be attained without causing the movable contact to have a complex structure.

BRIEF DESCRIPTION OF THE DRAWINGS

FIG. 10 is an axial cross-sectional diagram showing the principal portion of the spiral-arc circuit breaker according to another embodiment of the invention;

FIG. 11 is a diagram illustrating the imaginary pattern of the moving arc current achieved by the circuit breaker shown in FIG. 10; and FIG. 12 is an axial cross-sectional diagram showing the circuit breaker according to still another embodiment of the present invention.

DETAILED DESCRIPTION OF THE PREFERRED EMBODIMENTS

Figure 1:
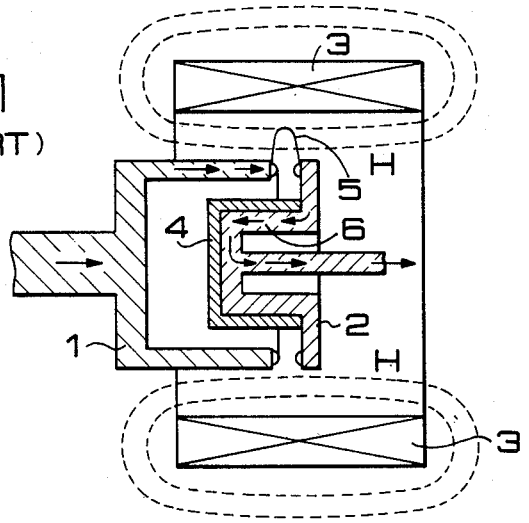
FIG. 1 (PRIOR ART)
FIG. 1 is an axial cross-sectional diagram showing the principal portion of the conventional spiral-arc circuit breaker.
Figure 2:
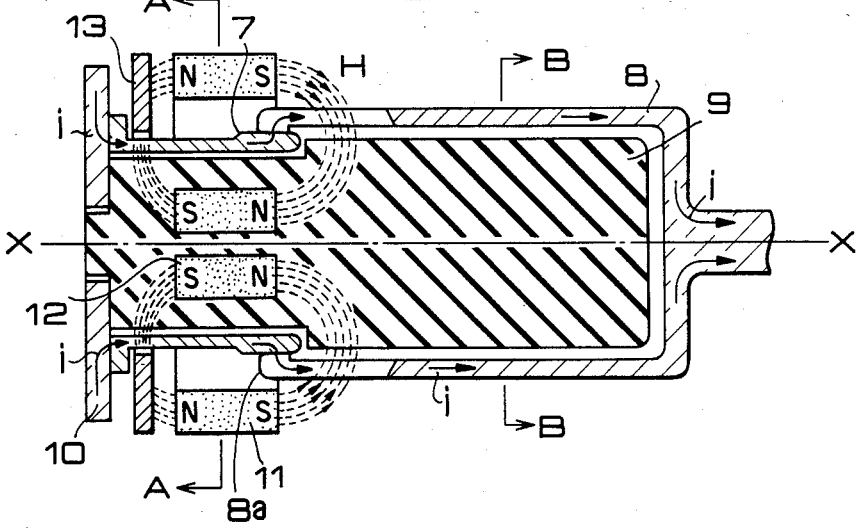
FIG. 2 is an axial cross-sectional diagram showing the principal portion of the spiral-arc circuit breaker in the closed-contact state according to one embodiment of the present invention.
Figure 3:
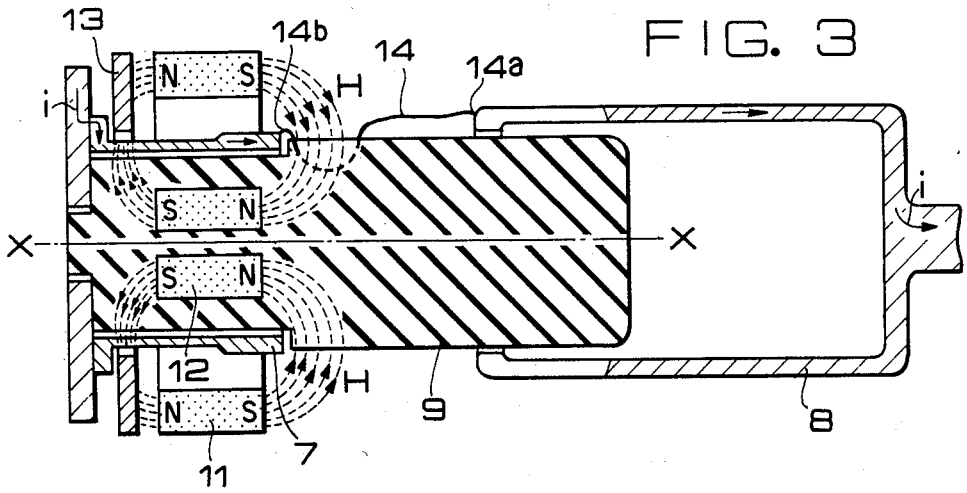
FIG. 3 is an axial cross-sectional diagram showing the same circuit breaker as shown in FIG. 2, but in the open-contact state.
Figure 4:
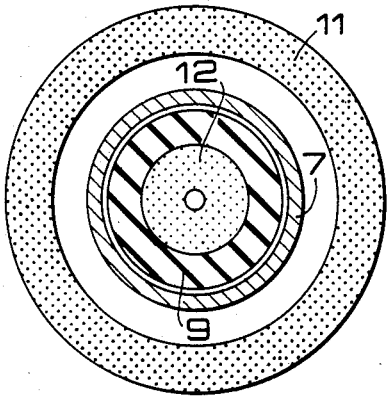
FIG. 4 is a cross-sectional diagram taken along the line A—A of FIG. 2.
Figure 5:
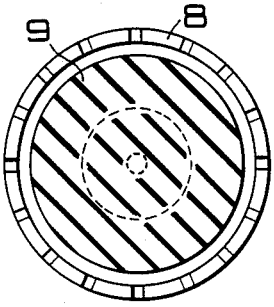
FIG. 5 is a cross-sectional diagram taken along the line B—B of FIG. 2.
Figure 6:
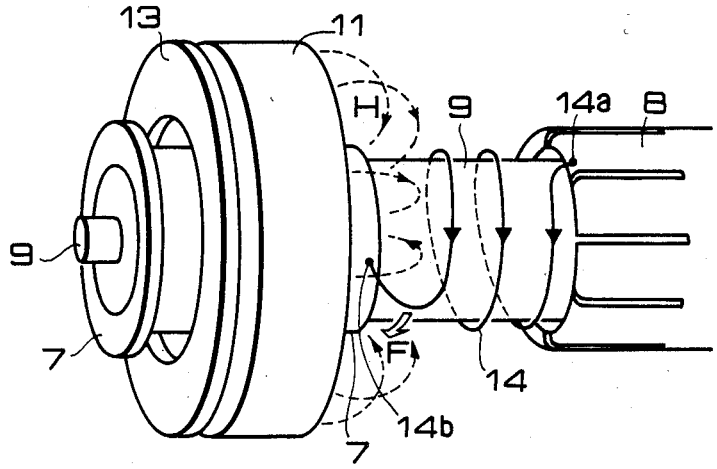
FIG. 6 is a perspective view of the open-state circuit breaker shown in FIG. 3, illustrating the imaginary patterns of the spark and magnetic flux.

FIGS. 2 and 3 show the cross section of the spiral-arc circuit breaker in the closed-contact and open-contact states, respectively, according to one embodiment of the present invention, FIGS. 4 and 5 show the cross sections taken along the line A—A and line B—B, respectively, of FIG. 2. FIG. 6 shows perspectively part of the circuit breaker in the open-contact state.

Throughout FIGS. 2 to 5, reference number 7 denotes a cylindrical fixed contact and reference number 8 denotes a cylindrical movable contact disposed coaxially with respect to the fixed contact. Reference number 9 denotes an electrical insulator such as Teflon formed in a substantially cylindrical shape, and it occupies the substantially whole space formed in the interior of the contacts 7 and 8 during the closed-contact state shown in FIG. 2. The fixed contact 7 and insulator 9 are secured at their one ends to a terminal plate 10, while the movable contact 8 is linked to a drive mechanism (not shown) so that it is moved along the axis X—X between the position of contact with the fixed contact 7 and the position located apart by a certain distance from the contact position.

In this embodiment, the movable contact 8 has an inside diameter slightly larger than the outside diameter of the fixed contact so that the protrudent portion formed at the front end of the movable contact 8 is in contact with the outer surface of the fixed contact 7 when the circuit breaker is in the closed state shown in FIG. 2. In order to ensure the contact, a plurality of slits are formed extending axially from the front end of the movable contact 8 in an appropriate length, thereby providing a proper elasticity for the front end of the movable contact 8.

There is provided a means for forming a spiral arc between the fixed contact 7 and the separating movable contact 8, and it is made up of the first permanent magnet 11 located in the exterior of the fixed contact 7 and the second permanent magnet 12 located in the interior of the fixed contact 7. The first magnet 11 is of cylindrical type having an inside diameter larger than the outside diameter of the fixed contact 7, and in this embodiment it is magnetized to have the S-pole at the end nearer to the movable contact 8 and the N-pole at the opposite end. The second magnet 12 is of cylindrical type having an outside diameter smaller than the inside diameter of the fixed contact 7, and it is magnetized oppositely to the first magnet 11 and embedded in the insulator 9. Accordingly, a magnetic field H having components substantially perpendicular to the axis of the fixed contact 7 is produced in front of the fixed contact 7 as shown by the dashed arrows in FIGS. 2, 3 and 6. Reference number 13 denotes an annular magnetic plate disposed adjacently to the N-pole end of the first magnet 11 so that the leakage flux in a space between the N-pole of the first magnet 11 and the S-pole of the second magnet 12 is reduced.

Next, the operation of the inventive circuit breaker will be described. In the closed-contact state, the current i flows through the terminal plate 10 to the fixed contact 7, and to the movable contact 8 as shown in FIG. 2. Next, in the open-contact operation, the movable contact 8 is moved to the right by a drive mechanism (not shown) linked with the contact in response to the open-contact command, as shown in FIG. 3. When the fixed contact 7 and movable contact 8 are separated, arc 14 is created between the contacts. The arc 14 flows in the axial direction and part of the arc in the vicinity of the fixed contact 7 intersects the magnetic field produced by the permanent magnets 11 and 12 perpendicularly to the axis X—X, generating an electromagnetic force based on the Fleming's left-hand rule in the circumferential direction along the exterior surface of the insulator 9.

Figure 7A:
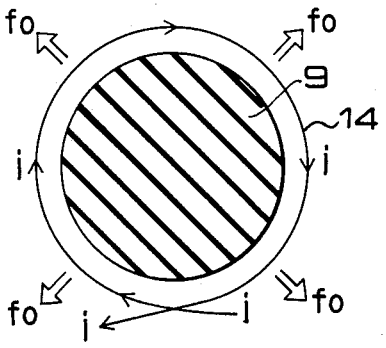
FIGS. 7(*a*) and 7(*b*) are diagrams illustrating the imaginary pattern of the moving arc current in the circumferential direction and axial direction, respectively.
Figure 7B:
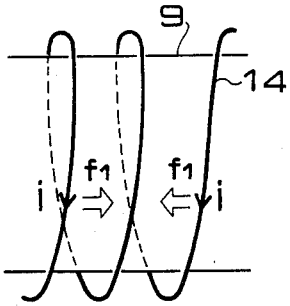
Figure 8:
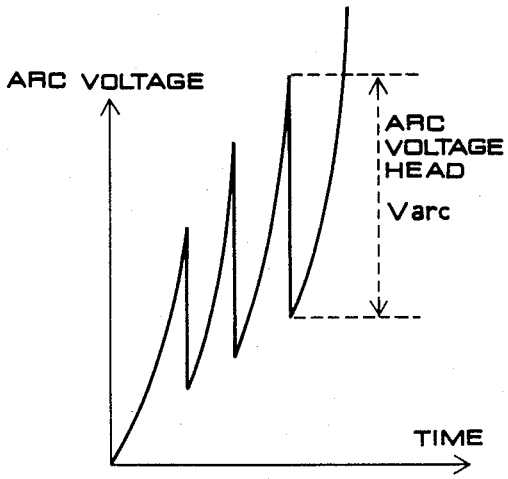
FIG. 8 is a graph showing, as an example, the variation of the arc voltage plotted against time.

On the other hand, part of the arc 14 in the vicinity of the movable contact 8 is not conducted by the external magnetic field and the foot 14*a* of the arc 14 is fixed to the movable contact 8. The foot 14*b* of the arc 14 at the fixed contact 7 is moved by the electromagnetic force in the circumferential direction, and therefore the arc 14 twines spirally around the column of insulator 9 at a high speed as shown in Figs. 6 and 7. The spiral arc 14 creates a radial reaction force $f_0$ due to the magnetic field caused by the current of itself as shown in FIG. 7(*a*), causing itself to expand outwardly to have a large outside diameter of the spiral arc 14. Then, the length of the arc 14 increases, the arc resistance increases, and thus the arc voltage increases. As the number of turns of the spiral arc 14 increases, an attractive electromagnetic force $f_1$ acts between turns of arc 14 having the same current direction as shown in FIG. 7(*b*), causing a short circuit between turns of the spiral arc 14, that is followed by a sharp drop of the arc voltage. The short-circuitted arc 14 flows along the axis X—X between the fixed contact 7 and movable contact as shown in FIG. 3. Subsequently, the spiral arc 14 is created again due to the foregoing mechanism between the arc 14 along the axis X—X and the magnetic field H in the direction perpendicular to the axis X—X. Generation of the spiral arc and short circuit of the arc are repeated cyclically, and the arc voltage rises and falls sharply as shown in FIG. 8.

Figure 9:
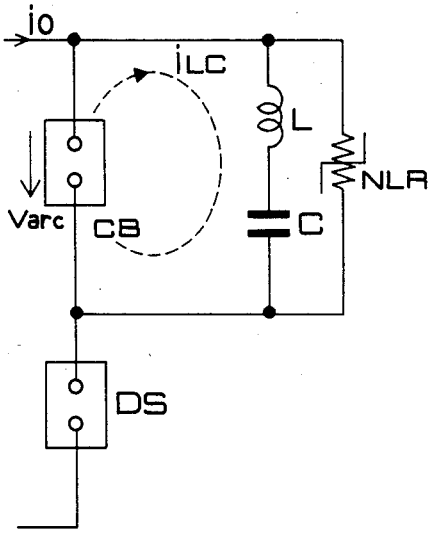
FIG. 9 is a schematic diagram showing one embodiment of the present invention applied to the commutating circuit breaker.

The present invention is best suited for the commutating circuit breaker for shutting off a high-voltage d.c. current. FIG. 9 shows one embodiment of such application, in which the circuit arrangement includes a commutating circuit breaker CB, a capacitor C in the commutating circuit, an inductor L in the commutating circuit, and a disconnecting switch DS. When the open-contact command is given to the commutating circuit breaker CB, this inventive d.c. circuit breaker produces a sharp arc voltage rise and a large arc voltage head through the creation of the spiral arc and occurrence of short circuit of the arc. This large arc voltage head causes the capacitor C and inductor L in the commutating circuit to generate an oscillating current $i_{LC}$, and the main circuit current $i_0$ is commutated from the path of the commutating circuit breaker CB to the path of the commutation circuit including the capacitor C and inductor L. After the main circuit current $i_o$ has shunted to the commutation circuit, the commutating circuit breaker CB operates to shut off the current. In the commutation circuit, the capacitor C is charged and the nonlinear resistance element NLR has an increasing resistance in a transient period, resulting in a reduction in the commutating current and, thus, the main circuit current $i_o$. Part of the main circuit current $i_o$ which complements the reduced current in the commutation circuit is shut off finally by the disconnecting switch DS.

According to the inventive arrangement of the circuit breaker, the magnetic field H is produced perpendicularly to the axis of the electrodes X—X, making it suitable for the arc 14 to be created in the direction of the axis X—X. This does not necessitate the structure for reversing the current direction in the movable contact 8, as has been practiced in the conventional design, resulting a simple structure for the electrodes. In addition, the interior of the fixed contact 7 is utilized effectively to accommodate the magnet 12, making possible the generation of an extremely strong magnetic field using a small room. Moreover, an excitation winding for generating the magnetic field is not needed and thus the copper loss due to the winding is not created.

While in the above embodiment the permanent magnets 11 and 12 are used to generate the magnetic field H, the arrangement is not limited to this, but one of them may be replaced with a non-magnetized magnetic member.

FIG. 10 is a cross-sectional view of the principal portion of the modified version of the inventive high-voltage d.c. circuit breaker. The arrangement includes a cylindrical fixed contact 7 secured to a terminal plate 10, a cylindrical movable contact 8 provided coaxially and detachably with respect to the fixed contact 7, with its sliding contact section wiping the fixed contact 7 being formed in a finger shape, cylindrical permanent magnets 11 and 21 disposed coaxially inside the contacts 7 and 8, respectively, with the N-pole of the magnet 11 confronting the S-pole of the magnet 21, and cylindrical permanent magnets 12 and 22 disposed coaxially outside the contacts 7 and 8, respectively, with their magnetic poles opposing each other. The permanent magnets 11 and 12 produce the magnetic field at the front end of the fixed contact 7 in the outward radial direction as shown by the arrow H1, while the permanent magnets 21 and 22 produce the magnetic field at the front end of the movable contact 8 in the inward radial direction as shown by the arrow H2. The arrangement further includes an annular heel piece pair 16 and 17 secured to the left end faces of the permanent magnets 11 and 12, and another annular heel piece pair 18 and 19 secured to the right end faces of the permanent magnets 21 and 22. These heel pieces serve to reduce the magnetic resistance between the permanent magnets 11 and 12, and between 21 and 22 so as to enhance the magnetic fields. The heel pieces 16 and 17 for the permanent magnets 11 and 12 are secured to the fixed contact 7 through a fixture (not shown), and the heel pieces 18 and 19 for the permanent magnets 21 and 22 are secured to the movable contact 8 in the same way.

The operation of the spiral-arc d.c. circuit breaker arranged as described above will be explained. FIG. 11 shows the behavior of the arc created between the contacts 7 and 8. The arc 14 is formed between a point on the fixed contact 7 and a point on the movable contact 8 in the axial direction immediately after the contacts 7 and 8 have separated from each other, and the current shown by the arrow 23 always has a component intersecting at right angles the magnetic fields shown by the arrows H1 and H2, resulting in the generation of the electromagnetic force based on the Fleming's left-hand rule at both ends of the arc 14. In consequence, one end of the arc 14 nearer to the fixed contact 7 moves on the circumference in the direction shown by the arrow 24, while another end of the arc 14 nearer to the movable contact 8 moves on the circumference in the direction of the arrow 25 oppositely to the previous direction 24. Thus, both ends of the arc 14 rotate on the circumferences at the front ends of the contacts 7 and 8 in opposite directions, forming the arc 14 in the shape of spiral as shown in FIG. 11, and its increasing length sharply raises the arc voltage. Once the arc 14 has grown into a spiral, the arc current creates a new magnetic field in the direction shown by the arrow 26 and, in consequence, the electromagnetic force acts on the arc 14 in the direction shown by the arrow 27 to increase the diameter of the spiral. This further enhances the rise of the arc voltage, allowing the contacts to shut off a high-voltage, large d.c. current. The arc 14 shown in FIG. 10 represents a specific transient form of arc for the explanatory purpose, and appears differently from the arc 14 shown in FIG. 11.

While in the above embodiment the permanent magnets 21 and 22 are secured to the movable contact 8, they may be fixed to certain positions corresponding to the movable contact 8 in the open-contact state through an additional fixture. Some of the permanent magnets, e.g., 11 and 21, or 12 and 22 may be replaced with non-magnetized magnetic members having a high permeability, and moreover, the permanent magnets may be replaced with excitation windings. The present invention is not limited to d.c. circuit breakers, but can also be applicable to a.c. circuit breakers.

FIG. 12 is a cross-sectional diagram showing the principal portion of the arc extinction chamber in the spiral-arc d.c. circuit breaker according to still another embodiment of the present invention. The fixed contact 7, movable contact 8, insulator 9, terminal plate 10, and arc 14 shown in the figure are identical to those shown in FIG. 2 and explanation thereof will be omitted. The arrangement further includes a cylindrical permanent magnet 31 embedded in the insulator 9 coaxially to the contacts 7 and 8 at a position so that it is located at a virtual middle point between the front ends of the contacts 7 and 8 in the open-contact state, a cylindrical permanent magnet 32 disposed coaxially outside the contacts 7 and 8 in the opposite polarity relationship with respect to the permanent magnet 31, disk-shaped heel pieces 33 secured to both end faces of the permanent magnet 31 embedded in the insulator 9, and annular heel pieces 34 secured to both end faces of the permanent magnet 32. The heel pieces 34 in conjunction with heel pieces 33 serve to reduce the magnetic resistance in a space between the permanent magnets 31 and 32. The combination of the permanent magnets 31 and 32 and the heel pieces 33 and 34 produces the magnetic fields at the front ends of the contacts 7 and 8 in the opposite radial directions shown by the arrows H3 and H4. Another component referred to by 35 is an insulation ring made of Teflon or the like for electrically insulating the permanent magnet 32 and heel piece 34 from both contacts 7 and 8. In this arrangement, due to the presence of the insulator 9 in close proximity to the inner surfaces of the contacts 7 and 8, the arc path is held on the surface of the insulator 9, resulting in the more stable formation of spiral arc as compared with the previous embodiments shown in FIGS. 2 and 10. The permanent magnet 31 and heel piece 33 are secured to the terminal plate 10 by being embedded in the insulator 9, and thus protected from exposure to the arc and supported firmly.

The insulator 9 does not need to be solid for the purpose of the stable formation of the spiral arc, but it may be formed in the shape of a bore cylinder. The permanent magnets may be split axially as in the case of the embodiment shown in FIG. 10. In addition, some of the permanent magnets may be replaced with high-permeability magnetic members, all permanent magnets may be replaced with excitation windings, and the arrangement is also applicable to a.c. circuit breakers, as in the cases of the embodiments shown in FIGS. 2 and 10.

According to the present invention, as described above, magnetic fields in opposite polarity relationship are produced at the entire front ends of both contacts in the radial direction perpendicular to the axial direction, and the arc is twisted in a spiral shape by means of a magnetic field generator with a small magnetomotive force. Provision of the insulator in proximity to the interior of both contacts functions to hold the arc path on the surface of the insulator, and it is effective for stabilizing the formation of the spiral arc.

What is claimed is:

1. A circuit breaker of spiral arc type comprising:

a cylindrical fixed contact secured at one end to a terminal plate;

a cylindrical movable contact provided coaxially with respect to said fixed contact and adapted to move in the axial direction between a closed-contact position at which said fixed and movable contacts are in contact with each other and an open-contact position spaced from the position of said fixed contact by a predetermined distance; and means for producing a magnetic field having a first component intersecting at substantially right angles the common axis of said contacts in front of the front end of said fixed contact and a second component intersecting at substantially right angles the common axis in front of the front end of said movable contact inside a substantially cylindrical space formed between said fixed contact and said movable contact in the open-contact position;

said magnetic field producing means comprising a first magnet located inside said cyindrical space formed between said fixed and movable contacts, a pair of heel pieces provided on both ends of said first magnet, a second magnet disposed coaxially outside said cylindrical space, and a pair of ring-shaped heel pieces provided on both ends of said second magnet, said first component of magnetic field being produced in a space between said heel pieces provided on one end of said first and second magnets, said second component of magnetic field being produced in a space between said heel pieces provided on another end of said first and second magnets.

2. A circuit breaker according to claim 6, wherein said magnetic field producing means comprises a first cylindrical magnet disposed coaxially outside said fixed contact and a second magnet provided inside said fixed contact for producing said first component of magnetic field, and a third cylindrical magnet disposed coaxially outside said movable contact and a fourth magnet provided inside said movable contact for producing said second component of magnetic field.

* * * * *

UNITED STATES PATENT AND TRADEMARK OFFICE

CERTIFICATE OF CORRECTION

PATENT NO. : 4,560,848

DATED : December 24, 1985

INVENTOR(S) : Satomi Arimoto

It is certified that error appears in the above-identified patent and that said Letters Patent is hereby corrected as shown below:

Column 1, lines 4 and 5,

"BACKGROUND OF THE INVENTION cl Field of the Art"

should read:

-- BACKGROUND OF THE INVENTION

Field of the Art --.

Column 8, line 22, the numeral "6" should be --1--.

Signed and Sealed this

*Fifteenth* Day of *April 1986*

[SEAL]

*Attest:*

DONALD J. QUIGG

*Attesting Officer*

*Commissioner of Patents and Trademarks*